US010784592B2

(12) United States Patent
Martiskainen et al.

(10) Patent No.: US 10,784,592 B2
(45) Date of Patent: Sep. 22, 2020

(54) ISOLATED GROUND FOR WIRELESS DEVICE ANTENNA

(71) Applicant: GALTRONICS USA, INC., Tempe, AZ (US)

(72) Inventors: Matti Martiskainen, Upper Tiberias (IL); Eun-Gyu Bae, Suwon-Si (KR); Sharon Harel, Industrial Zone (IL); Jongmin Na, Suwon-si (KR); Taihong Kim, Busan (KR); Jaeyun Hwang, Suwon-si (KR); Bumjin Kim, Suwon-si (KR); Yeonhyeon Song, Suwon-si (KR); Suhyun Kim, Suwon-si (KR); Sangyup Kim, Suwon-si (KR)

( * ) Notice: Subject to any disclaimer, the term of this patent is extended or adjusted under 35 U.S.C. 154(b) by 5 days.

(21) Appl. No.: 15/126,715

(22) Filed: Sep. 16, 2016

(65) Prior Publication Data

US 2019/0051992 A1 Feb. 14, 2019

(51) Int. Cl.

| | |
|---|---|
| ***H01Q 21/30*** | (2006.01) |
| ***H01Q 1/24*** | (2006.01) |
| ***H01Q 21/28*** | (2006.01) |
| ***H01Q 1/52*** | (2006.01) |

(52) U.S. Cl.

CPC ..... *H01Q 21/30* (2013.01); *H01Q 1/243* (2013.01); *H01Q 1/521* (2013.01); *H01Q 21/28* (2013.01)

(58) Field of Classification Search

CPC ..... H01Q 1/366; H01Q 1/243; H01Q 1/38; H01Q 9/0421; H01Q 1/42; H01Q 1/1207

USPC ..... 343/701, 702, 872, 878

See application file for complete search history.

(56) References Cited

U.S. PATENT DOCUMENTS

| | | | | |
|---|---|---|---|---|
| 6,836,247 | B2 * | 12/2004 | Soutiaguine | H01Q 9/0414 343/700 MS |
| 2005/0017902 | A1 * | 1/2005 | Oyama | H01Q 1/241 343/700 MS |
| 2012/0112970 | A1 * | 5/2012 | Caballero | H01Q 1/243 343/702 |
| 2012/0139793 | A1 * | 6/2012 | Sharawi | H01Q 1/38 343/700 MS |
| 2014/0177531 | A1 * | 6/2014 | Imamura | H04W 24/10 370/328 |

* cited by examiner

*Primary Examiner* — Graham P Smith
(74) *Attorney, Agent, or Firm* — Brion Raffoul

(57) ABSTRACT

A wireless device including multiple counterpoises or ground planes is provided. The wireless device may provide improved multiple input multiple output (MIMO) communication capability through the use of the multiple counterpoises. Multiple counterpoises of the wireless device may be galvanically isolated from one another. Multiple counterpoises may each be coupled to separate antenna elements.

6 Claims, 3 Drawing Sheets

ISOLATED GROUND FOR WIRELESS DEVICE ANTENNA

TECHNICAL FIELD

Embodiments of the present disclosure relate generally to antennas provided for electronic devices.

SUMMARY

Embodiments of the present disclosure are directed to a wireless device. The wireless device may include at least one dielectric substrate; a first counterpoise located on the at least one dielectric substrate; a second counterpoise, galvanically isolated from the first counterpoise, located on the at least one dielectric substrate; a first antenna element coupled to the first counterpoise, and configured to be operational in a first frequency band; and a second antenna element, coupled to the second counterpoise, configured to be operational in a second frequency band.

DETAILED DESCRIPTION

Figure 1:
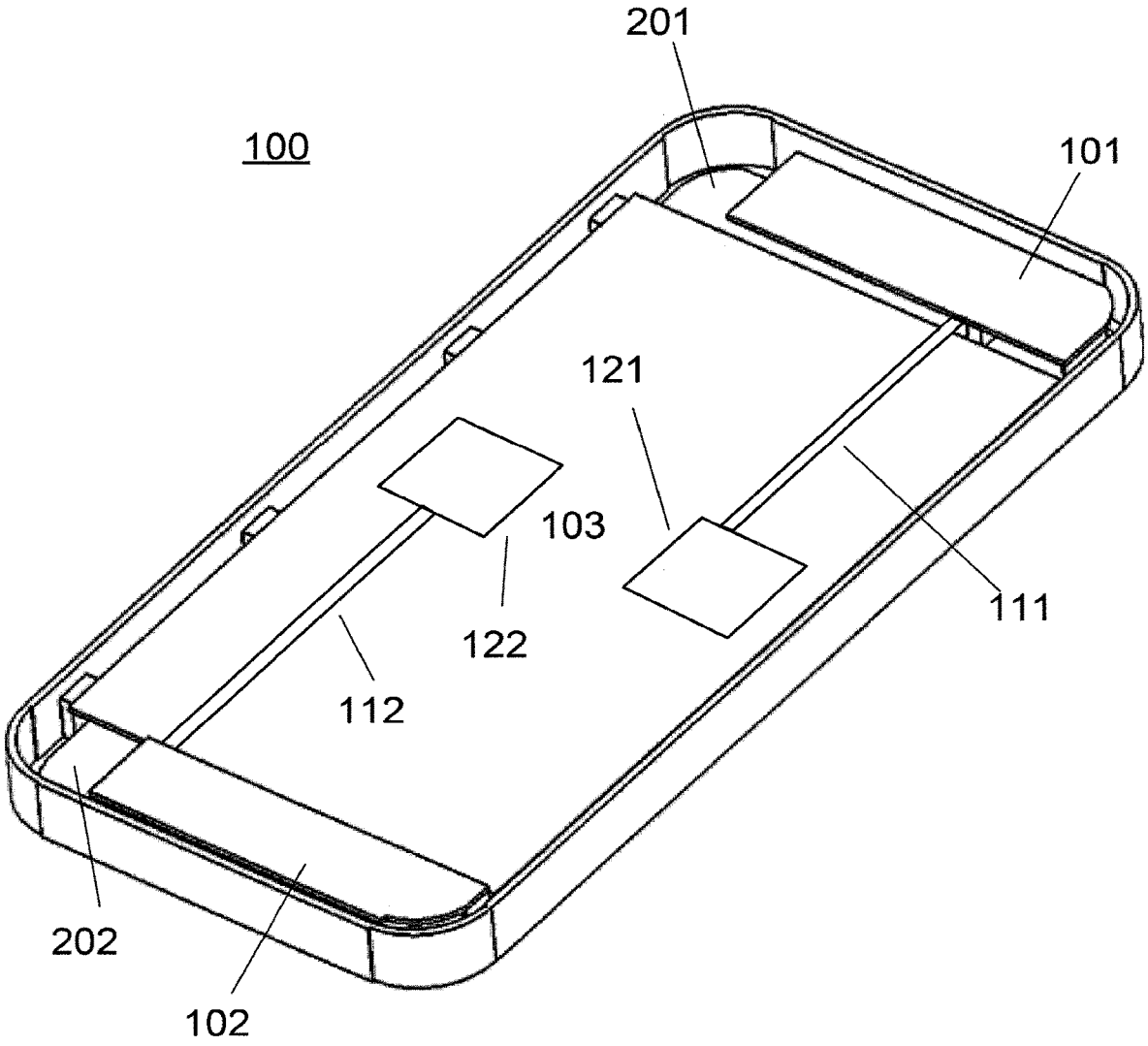
FIG. 1 illustrates a top-side perspective view of an exemplary antenna structure consistent with the present disclosure.

Reference will now be made in detail to exemplary embodiments of the present disclosure, examples of which are illustrated in the accompanying drawings. Wherever possible, the same reference numbers will be used throughout the drawings to refer to the same or like parts.

Embodiments of the present disclosure relate generally to wide bandwidth antennas provided for use in wireless devices. Multi-band antennas consistent with the present disclosure may be employed in mobile devices for cellular communications, and may operate at frequencies ranging from approximately 700 MHz to approximately 2.7 GHz. Multi-band antennas consistent with the present disclosure may further be employed for any type of application involving wireless communication and may be constructed to operate in appropriate frequency ranges for such applications. Multi-band antennas consistent with the present disclosure may be suited for use in multiple-input multiple-output (MIMO) antenna systems.

As used herein, the term antenna may collectively refer to the structures and components configured to radiate radiofrequency energy for communications. The term antenna may collectively refer to the multiple conductive components and elements combining to create a radiating structure. The term antenna may further include additional tuning, parasitic and trim elements incorporated into a wireless device to improve the function of radiating structures. The term antenna may additionally include discreet components, such as resistors, capacitors, and inductors and switches connected to or incorporated with antenna components. As used herein, the term antenna is not limited to those structures that radiate radiofrequency signals, but also includes structures that serve to feed signals to radiating structures as well as structures that serve to shape or adjust radiation patterns.

In MIMO antenna systems, at least two antennas operating in overlapping or even substantially identical frequency ranges may be employed in a wireless device. Such systems may increase the capacity of a radio link by permitting the employment of multiple signal propagation pathways. MIMO systems may be employed to increase the throughput and/or the reliability of a single user's communications and also may be employed to increase the number of users able to simultaneously use an antenna system. Each of the at least two antennas may include all of the components and elements of a single antenna structure, including feed lines, radiating elements, grounding elements, and any additional features suitable for inclusion in an antenna structure.

In compact, handheld, wireless devices, the at least two antennas that constitute a MIMO antenna system may be located close to each other and may even share structural elements. In some MIMO systems, two or more antenna systems may share a common counterpoise, or grounding element. In some designs, this may result in interference between the two or more antennas of the MIMO system. Such interference may be particularly prevalent in lower frequency bands of operation, which may, in turn, lead to losses in radiation efficiency.

Such losses in radiation efficiency may be reduced or eliminated through the use of isolation techniques that may increase signal independence. Permitting the multiple signals in a MIMO system to operate independently from one another may reduce the amount of interference between the signals, and therefore increase radiation efficiency. In some embodiments disclosed herein, isolation between two or more antennas in a MIMO system may be enhanced or improved through the use of multiple floating ground planes.

Wireless electronic device antenna system structures may include multiple layers, including, for example, a main printed circuit board (PCB) layer and additional layers, such as a device housing, within which antenna elements may be located, and a battery cover.

In accordance with one embodiment of the disclosure, a part or all of such additional layers may be formed with a conductive material on at least one side thereof, so as to form one or more counterpoises or ground planes. A counterpoise may be formed by a conductive material positioned on a substrate. These counterpoises may be separated from the main PCB or chassis of the device. As a result of the separation between the one or more counterpoises and the main PCB and chassis of the electronic device, radiofrequency currents of respective signals associated with individual antennas may make use of separated counterpoises. Multiple antennas of a MIMO system, therefore, may not be required to share a common counterpoise. Isolation between multiple antennas of a MIMO antenna system in a handheld device may therefore be improved.

In accordance with another disclosed embodiment, a conductive layer may be formed adjacent to an outer surface of a wireless device by means of in-mold labeling. Such a layer may be conductive on an inner surface thereof, and may include a dielectric layer on an outer surface thereof. Such a layer may provide an additional counterpoise for a wireless device.

FIG. 1 illustrates a top-side perspective view of an exemplary MIMO antenna system consistent with the present disclosure. As illustrated in FIG. 1, a first antenna 101 and a second antenna 102 may be located at opposite ends of a wireless device 100. Between the first and second antennas 101, 102 may be positioned a wireless device PCB board 103, which may include any or all of the components required by the wireless device. For example, PCB board 103 may include components such as at least one processor, at least one memory or storage device, as well as appropriate signal conditioning components for wireless device 100. FIG. 1 further illustrates the location of a first counterpoise 201 and a second counterpoise 202, located on a plane offset from the main PCB board 103. As illustrated in FIG. 1, first and second counterpoises 201, 202 may be located between PCB board 103 and a back (i.e., non-screen side) of wireless device 100. In alternate embodiments, first and second counterpoises 201, 202 may be located between PCB board 103 and a screen side of wireless device 100.

Figure 2:
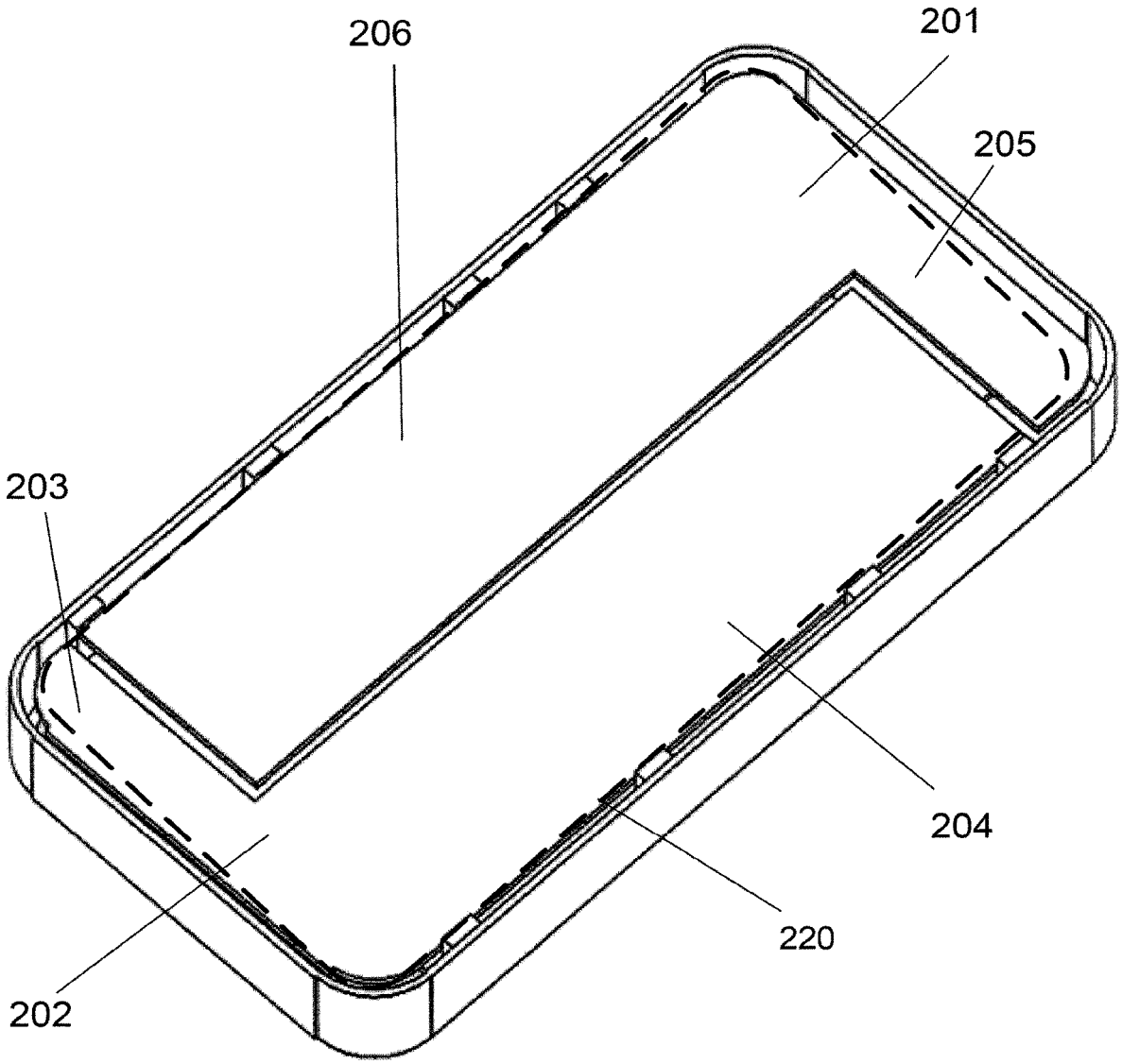
FIG. 2 illustrates an underside perspective view of an exemplary antenna structure consistent with the present disclosure.

FIG. 2 illustrates a bottom-side perspective view of an exemplary antenna system consistent with the present disclosure. As illustrated in FIG. 2, a first counterpoise 201 and a second counterpoise 202 may be positioned in a plane offset from PCB board 103. First and second counterpoises 201, 202 may be galvanically isolated from one another. First and second counterpoises 201, 202 may be located on at least one dielectric substrate 220. In FIG. 2, dielectric substrate 220 is illustrated with a dotted line to better show counterpoise 201 and counterpose 202, located on dielectric substrate 220. Dielectric substrate 220 may be located on either side of the counterpoises, e.g., either between the counterpoises and the back of the device 100, or between the counterpoises and the front of the device 100. In some embodiments, each of first and second counterpoise 201, 202 may be located on a separate dielectric substrate 220. That is, each counterpoise may be located on a dielectric substrate that is not directly physically connected to the dielectric substrate on which the other counterpoise is located. In some embodiments, first and second counterpoise 201, 202 may be located on a common dielectric substrate, and may be printed or otherwise deposited on a common dielectric substrate with gaps there between so as to maintain galvanic isolation from one another. In some embodiments, first and second counterpoise 201, 202 may be substantially coplanar. In some embodiments, the dielectric substrate may form at least a portion of a device housing, for example, a back cover of the device, as illustrated in FIG. 3. First and second counterpoises may be deposited on or in such a back cover via any suitable means, such as printing, injection molding, and/or laser direct structuring.

In the embodiment illustrated in FIG. 2, first and second counterpoises 201, 202 are located on a dielectric substrate that forms at least a portion of a back cover of a housing of wireless device 100. In the illustration of FIG. 2, dielectric substrate 220 and the back cover are not shown, so as to provide a view of first and second counterpoises 201, 202. First and second counterpoises 201, 202 may be galvanically isolated from one other, and may be arranged or located in order to provide suitable ground plane characteristics for first and second antennas 101 and 102.

For example, first and second counterpoises 201, 202 may each be L-shaped. First counterpoise 201 may include a first foot 203 and a first leg 204. Foot 203 may be arranged in proximity to first antenna 101, and may be galvanically or otherwise coupled to first antenna 101, so as to provide a ground plane element for first antenna 101. Radiating or coupling elements of antenna 101 may excite first counterpoise 201 to radiate in at least one frequency band consistent with a frequency band of antenna 101. Second counterpoise 202 may include a second foot 205 and a second leg 206, and may be arranged with respect to second antenna 102 in a similar fashion as first counterpoise 201 is arranged with respect to first antenna 101. First and second feet 203, 205 may be substantially parallel to one another. First and second legs 204, 206 may also be substantially parallel to one another.

The L-shaped designs for first and second counterpoises 201, 202, as illustrated in FIG. 2, may provide advantages in the limited space of a wireless device. For example, first foot 203 and second foot 205, may be arranged to substantially overlap the projection of elements of first antenna 101 and second antenna 102, respectively. This arrangement may maximize the available space for coupling between each antenna and its respective counterpoise. As illustrated in FIG. 1, first antenna 101 and second antenna 102 may be located at either end of wireless device 100. Projections of first antenna 101 and second antenna 102 onto a plane occupied by first counterpoise 201 and second counterpoise 202 may have substantial overlap with first foot 203 and second foot 205. This arrangement may maximize the space in which to locate elements to couple first antenna 101 to first counterpoise 201 and second antenna 102 to second counterpoise 202.

The positioning of first and second leg 204, 205 may also provide an advantage in a compact wireless device. First and second leg 204, 205 extend in an overlapping fashion, which permits each leg to be longer than may otherwise be possible. The substantially parallel, overlapping extension of first and second legs 204, 205 permit each leg to extend for a substantial portion of an entire length of wireless device 101. The extended physical length of first and second legs 204, 205 may increase the electrical length of each leg. As used herein, electrical length refers to the length of a feature as determined by the portion of a radiofrequency signal that it may accommodate. For example, a feature may have an electrical length of $\lambda/4$ (e.g., a quarter wavelength) at a specific frequency. An electrical length of a feature may or may not correspond to a physical length of a structure, and may depend on radiofrequency signal current pathways. Features having electrical lengths that appropriately correspond to intended radiation frequencies may operate more efficiently. The increase in electrical length of first and second legs 204, 205 of first and second counterpoises 201, 202 may permit counterpoises 201, 202 to radiate more effectively in a low frequency band.

Each of counterpoises 201, 202 may form a counterpoise for antennas 101 and 102, respectively. First and second antennas 101, 102 may include any antenna element suitable for inclusion in a wireless device, including a PIFA antenna, as illustrated in FIGS. 1 and 2, a folded monopole antenna, a conductive frame antenna, a slot antenna, a slit-fed antenna, or any other suitable antenna. Any suitable antenna element may be included with the isolated counterpoise embodiments disclosed herein. As a result of each antenna element utilizing a separate counterpoise, isolation between the antennas may be increased and diversity gain may be improved. In some embodiments, first and second antennas 101 and 102 may include high-band antenna elements, configured for radiation at a frequency range between 1700-2700 MHz. In some embodiments, first and second antennas 101 and 102 may be configured to couple to and excite respective first and second counterpoises to cooperate to radiate as a low-band antenna. Such a low-band antenna may radiate at a frequency range between 700-1200 MHz.

Wireless device 100 may include at least one feed line 110. At least one feed line 110 may be a coaxial cable or other suitable RF connector. At least one feed line 110 may be connected to at least one radio 120, located on PCB 103. In some embodiments, each antenna of a MIMO antenna system may include a separate feed line 110. For example, antenna 101 and counterpoise 201 may be coupled to a first feed line 111, which may be coupled to a first radio 121 located on PCB 103. Second antenna 101 and second counterpoise 202 may be coupled to a second feed line 112, which may be coupled to a second radio 122 located on PCB 103. Each feed line may be configured to transfer a signal to the respective antenna and counterpoise to which it is connected.

Although FIGS. 1 and 2 illustrate two L-shaped counterpoise structures, positioned in a substantially coplanar manner, and two PIFA antennas, the present disclosure is not limited to these embodiments. For example, any suitable antenna for use in a wireless device may be used in addition to or in place of one of the two illustrated PIFA antennas. Such antennas may include folded monopole antennas, slot antennas, slit fed antennas, loop antennas, conductive frame antennas, and others.

Counterpoise structures consistent with the present disclosure may also be of any suitable shape or size. Isolating the structures, one from another, facilitates the isolation of antenna structures that incorporate the respectively isolated counterpoises. The shape of the counterpoise structures may be consistent with maintaining a separation between the structures while providing a structure appropriately shaped and sized for use as both an antenna counterpoise and to radiate as an antenna element as necessary. The two counterpoise structures may be sized and shaped differently from each other, depending on the functional requirements of the antenna structure which the counterpoise structure supports. For example, in a MIMO system where multiple antennas radiate in different frequency bands, counterpoise structures may be required to differ in size and shape from one another to accommodate the different frequencies.

Further, the number of counterpoise structures is not limited to two, as a handheld electronic device may require three or more antennas, and thus a series of counterpoise structures respectively isolated from one another. Additionally, it is not required that multiple isolated counterpoise structures be located in a planar fashion, as illustrated in FIGS. 1 and 2. In some embodiments, depending on available space within an electronics device, it may be advantageous to position multiple isolated counterpoises on different planes, for example, to stack such counterpoises one atop another.

Figure 3B:
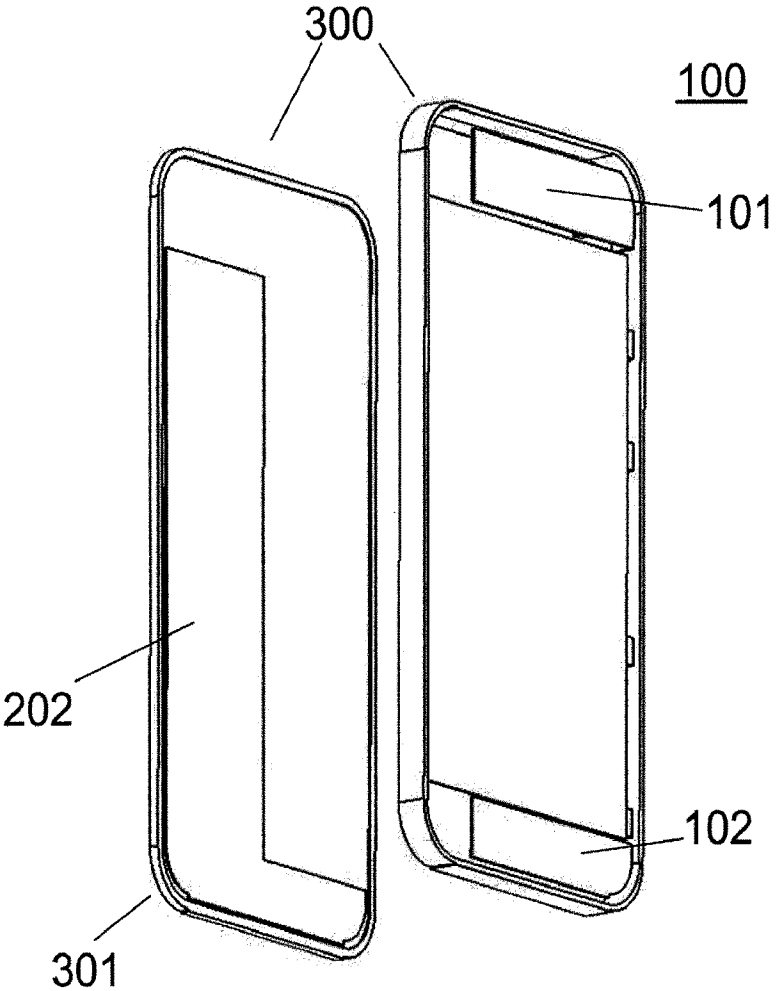
FIGS. 3*a* and 3*b* are perspective views of an exemplary embodiment consistent with the present disclosure.
Figure 3A:
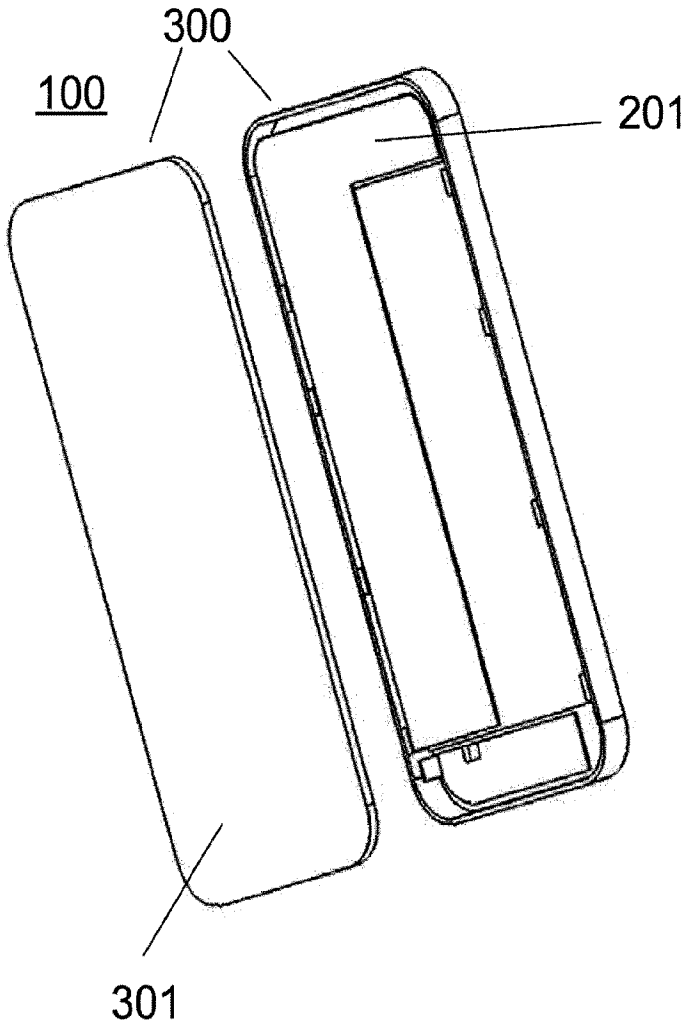

FIGS. 3*a* and 3*b* are perspective views of an additional embodiment consistent with the present disclosure. FIGS. 3*a* and 3*b*, illustrate device housing 300, which may include a removable or integrated back cover 301. For illustrative purposes, FIGS. 3*a* and 3*b* show back cover 301 removed from housing 300. FIG. 3*a* illustrates a back-side interior of wireless device 100 and a back-side of back cover 301. FIG. 3*b* illustrates an interior side of back cover 301 and a front-side interior of wireless device 100. As illustrated in FIG. 3, at least one counterpoise of a plurality of counterpoises may be incorporated in housing 300 of wireless device 100, for example, in a back cover 301 of housing 300 of wireless device 100. First counterpoise 201 may be located on a dielectric substrate within an interior space of housing 300. Second counterpoise 202 may be located in a back cover 301 of housing 300. Thus, as illustrated in FIG. 3, multiple counterpoises are located on separate dielectric substrates. The parts may be arranged however, such that first and second counterpoise 201, 202 may be located on a same plane or on different planes. A counterpoise located on back cover 301 may be deposited on or in back cover 301 via any suitable means, such as printing, injection molding, and/or laser direct structuring. Although back cover 301 is illustrated as a removable element of housing 300, back cover 301 may also be secured in a non-removable manner to housing 300 and may also be formed integrally with housing 300 of a continuous piece of material.

In some embodiments, multiple counterpoises consistent with the present disclosure may not be strictly planar. For example, in a wireless device featuring a curved form factor, multiple counterpoises may also be curved to conform to a curved housing.

Wireless device 101 may additionally include a main PCB 103, on which the electronics of the device may be located. In accordance with another disclosed embodiment, first antenna element 101 may utilize the main PCB/chassis as a first counterpoise and second antenna 102 element may use a separate layer including a dielectric substrate and conductive layer, offset from the plane of PCB 103, as a second counterpoise.

In accordance with still another disclosed embodiment, a length of at least one isolated counterpoise may be extended by connecting the isolated counterpoise to the main PCB 103 or chassis components. Such an isolated counterpoise structure may be L-shaped, having a leg end distal from the foot, which may be bent so as to be connected to the main PCB. This may be advantageous because, by lengthening one antenna counterpoise, the radiation pattern of the antenna element associated with the lengthened counterpoise structure may be modified, which may further reduce interference between multiple antennas within the wireless device.

It is appreciated that embodiments consistent with the present disclosure may be employed in electronic devices other than handheld wireless devices, including computers and other wireless devices having multiple antennas therein. It is further appreciated that embodiments as disclosed herein are not limited to application to two antennas within a wireless device; rather, multiple individual counterpoises may be provided for cooperation with multiple individual antennas within a wireless device.

What is claimed is:

1. A wireless device, comprising:

at least one dielectric substrate;

a first counterpoise located on the at least one dielectric substrate;

a second counterpoise, galvanically isolated from the first counterpoise, located on the at least one dielectric substrate;

a first antenna element coupled to the first counterpoise, and configured to be operational in a first frequency band;

a second antenna element, coupled to the second counterpoise, configured to be operational in a second frequency band; and wherein said first counterpoise and said second counterpoise are L-shaped and positioned on different planes stacked atop another.

2. The wireless device of claim 1, wherein the at least one dielectric substrate includes a first dielectric substrate, on which the first counterpoise is located, and a second dielectric substrate, on which the second counterpoise is located.

3. The wireless device of claim 1, wherein the first frequency band overlaps the second frequency band.

4. The wireless device of claim 1, wherein the first and second counterpoise are substantially co-planar.

5. The wireless device of claim 1, further comprising a processor located on the at least one dielectric substrate and grounded to the first counterpoise.

6. The wireless device of claim 1, wherein the at least one dielectric substrate forms at least a portion of a cover.

* * * * *